US005619981A

United States Patent [19]

Breedlove

[11] Patent Number: 5,619,981

[45] Date of Patent: Apr. 15, 1997

[54] ARCHERY BOW STABILIZER AND PROP

[76] Inventor: Charles E. Breedlove, 1708 S. Fairview Rd., Columbia, Mo. 65203

[21] Appl. No.: 596,736

[22] Filed: Feb. 5, 1996

[51] Int. Cl.[6] ..... F41B 5/20; F41B 5/14

[52] U.S. Cl. ..... 124/89; 124/86; 248/125.8; 248/156

[58] Field of Search ..... 124/1, 23.1, 86, 124/88, 89; 248/125.8, 125.9, 156, 508, 530; 403/161, 163, 247, 252, 406.1, 408.1

[56] References Cited

U.S. PATENT DOCUMENTS

| | | | |
|---|---|---|---|
| 1,851,779 | 3/1932 | Slater . | |
| 3,256,872 | 6/1966 | Koser . | |
| 3,589,350 | 6/1971 | Hoyt et al. | 124/89 X |
| 3,991,780 | 11/1976 | Maroski | 135/66 |
| 4,054,121 | 10/1977 | Hoyt | 124/89 |
| 4,474,296 | 10/1984 | Hartman | 211/13 |
| 4,674,472 | 6/1987 | Reis | 124/89 |
| 4,846,140 | 6/1989 | DiMartino | 248/156 X |
| 4,974,575 | 12/1990 | Mitchell | 124/88 |
| 5,106,044 | 4/1992 | Regard et al. | 248/169 |
| 5,186,276 | 2/1993 | Craig | 182/187 |
| 5,239,977 | 8/1993 | Thomas | 124/89 |
| 5,320,085 | 6/1994 | Hanneman | 124/89 |
| 5,509,400 | 4/1996 | Chalin | 124/86 |

OTHER PUBLICATIONS

Northeast Archery Inc., Advertisement for Power Lok Tree Stand Bow Holder, Western Bowhunter, Nov./Dec. 1995.

Gander Mountain Archery Catalog, Fall 1995, p. 51.

Bowhunters Discount Warehouse Catalog, Winter 1995, p. 128.

*Primary Examiner*—John A. Ricci

*Attorney, Agent, or Firm*—Richard J. Grundstrom

[57] ABSTRACT

An archery bow stabilizer and prop generally having a locking adaptor that attaches to the bow. A transition elbow attaches to the locking adaptor. A stabilizer-prop extends downward from the transition elbow. The stabilizer-prop in the preferred embodiment is telescoping to provide height adjustment. The lower end of the stabilizer-prop is inserted into a reciever attached to a hunting surface. The transition elbow also allows a conventional stabilizer to be used in conjunction with the stabilizer-prop. The stabilizer screws into another threaded bore at the end of the transition elbow. There is fixed and a stationary type transition elbow. Both allow attachment of the stabilizer-prop in a downward vertical position to hold the bow in an upright position. Both allow a conventional stabilizer to be screwed into the end, holding the stabilizer in an extended position, which is conventional in nature. The pivotal transition elbow rotates such that the stabilizer-prop can be positioned extending downward, as with the stationary transition elbow, or can be rotated so that the stabilizer-prop extends outward similar to a stabilizer. This also allows the bow to be held in either an upright vertical position or in a horizontal position, as desired by the archer. Again provisions are made to allow use of a conventional stabilizer. There are also two simple embodiments of the archery bow stabilizer and prop. These include a mounting bracket that incorporates the locking adapter and a portion of the transition elbow into a single unit. This provides a simplier method of manufacuting the archery bow stabilizer and prop. Another embodiment is a mounting block. The mounting blocks incorporate all the features of the stationary type transition elbow into one simple block. The block can be used individually or in plurality depending on bow stabilizer-prop clearance needed.

32 Claims, 13 Drawing Sheets

42
52
64

42
62
52
64
58
54
58

14
56
60
46

34
40
38
44

76

38
40
44
34
48
50
50

38
44
34
48

14
56
62
40
64
60
38
34
46

ARCHERY BOW STABILIZER AND PROP

BACKGROUND OF THE INVENTION

The present invention relates to an archery bow stabilizer and prop and more particularly to an apparatus that attaches to an archery bow used as a combination stabilizer and bow prop. When functioning as a bow prop the archery bow is held in an upright ready position.

The sport of archery is an ever growing industry. More and more attachments and improvements are being made to improve the accuracy of shooting and the comfort of the archer. A stabilizer is typically an add on feature. The stabilizer helps in balancing the bow and absorbing bow shock or vibration during shooting. This aids the archer in shooting more accurately and providing some comfort. The stabilizer is generally a weighted shaft that screws into a threaded bore above or on the handle of the bow. Since there are many types of stabilizers available this arrangement allows a wide variety to meet the archer's needs.

There are many types of bow holders or rests known in the art. There are hip rests that provide an attachment to allow the weight of the bow to be placed on the hips. There are bow stands in which an archery bow can be placed to hold a bow in an upright position or in a horizontal position. These are generally devices that rest upon or are attached to some surface. The bow typically sets within brackets of some sort or the lower end of the bow rests upon the surface and leans against the rest in a sort of tripod arrangement.

The rests or holders often are inefficient. They get in the way of the archer, are difficult to transport to different locations, interfere with shooting, produces excessive noise when trying to remove the bow while hunting and many do not hold a bow securely. Bows have been known to fall out of tree stands and falling over during meets while using prior art bow holders.

This invention provides a combination bow holder and bow prop. It allows the stabilizer, of the type disclosed herein, to also be used as a bow prop. It overcomes the problems of the prior known art. It provides a sturdy bow holder or prop that holds the bow at a ready position and at the same time provides an efficient stabilizer. The bow prop holds the bow so that it is always available at a convenient height. The bow can be removed and shot without any noise and the likelihood of the bow falling over is remote.

This invention may also help archers who may have some physical disability. Shooting a bow requires strength in the wrist, arms, shoulders and back. Individuals having a physical impairment may not have the strength to hold a bow at arms length for the time necessary to properly aim and/or follow a moving target while at the same time holding a drawn string.

This invention assist those individual not having strength or the endurance necessary for accurate shooting. The bow prop of this invention can hold the bow at a given height to relieve the downward weight at the end of an out reached arm. This greatly reduces the strength needed to hold a bow in an upright position with an extended arm.

Accordingly, it is an object of the present invention to provide an archery bow stabilizer and prop adapted to combine attachments to have a single attachment used as a stabilizer and a bow prop or holder. With the archery bow stabilizer and prop of this invention it has been found that accuracy of shooting is as good as or better than using a standard stabilizer.

Another object of the present invention is to provide an improved archery bow stabilizer and prop constructed to provide a bow prop or holder that is convenient to use, will not interfere with shooting and holds the bow a ready position.

A further object of the present invention is to provide an archery bow stabilizer and prop adapted for reducing strength necessary to hold an archery bow in an upright shooting position to thereby substantially improve the shooting ability of individuals having any loss of strength.

Still another object of the present invention is to provide an archery bow stabilizer and prop that may be attached to a bow using an existing threaded bore on the bow. The threaded bore is typically contained on all compound bows for attachment of a stabilizer. This invention is used in place of the standard stabilizer.

Still a further object of the present invention is to provide an archery bow stabilizer and prop that contains a transition elbow adapted for holding a prop used as either a prop or a stabilizer.

Another object of the present invention is to provide an archery bow stabilizer and prop adapted to use a standard stabilizer and a prop of this invention simultaneously. The basic archery bow stabilizer and prop construction of this invention is adapted to be used with or without a standard stabilizer.

SUMMARY OF THE INVENTION

To accomplish the foregoing and other objects of this invention there is provided an archery bow stabilizer and prop and more particularly to an archery bow stabilizer and prop that attaches to the bow, similar to a stabilizer, which has in the preferred embodiment a telescoping prop extending downward for holding the bow in a fixed position while sitting or standing during hunting or while shooting the bow in general.

The archery bow stabilizer and prop of this invention, in a basic embodiment, includes a locking adaptor, a transition elbow and a stabilizer-prop combination. The locking adapter attaches to the bow. A locking bolt is screwed into the bow similar to a bow stabilizer to attach the archery bow stabilizer and prop to the bow. The transition elbow attaches to the locking adaptor. The transition elbow contains threaded holes in a perpendicular relation ship. A stabilizer or the stabilizer-prop attached to the threaded bores on the transition elbow. The stabilizer-prop extends downward from the transition elbow when attached to a lower threaded bore or extends outward in a horizontal position for use as a stabilizer when attached to another of the threaded bores.

The transition elbow has two embodiments. One embodiment is a fixed or stationary transition elbow. The other is a pivoting transition elbow. The stabilizer-prop attached to the transition elbow can be pivoted from a horizontal position to a vertical position by pivoting the transition elbow. The transition elbow also allows a conventional stabilizer to be used, in either of the embodiments. The stabilizer screws into a threaded bore at the end of the transition elbow, while the stabilizer-prop would attach to a lower threaded bore.

The prop, in the preferred embodiment, is a telescoping staff that provides height adjustment. The lower end of the prop is inserted into a receiver. The receiver is attached to whatever surface the hunter is using. This could be a stand, a tree or the ground.

A second embodiment combines the locking adapter and a portion of the transition elbow. This embodiment has a mounting means. The mounting means is an elongated H shaped block. The first set of parallel arms functions as the locking adapter. It prevents the archery bow stabilizer and prop from rotation of the bow. The first set of parallel arms fit over the handle of the bow. The second set of parallel arms are similar to the body portion of the transition elbow. The shaft of the transition elbow fits between the second set of parallel arms. As in the first embodiment, the shaft of the transition elbow can be either stationary or pivotally attached.

These and other objects and features of the present invention will be better understood and appreciated from the following detailed description of the main embodiment thereof, selected for purposes of illustration and shown in the accompanying drawings.

DETAILED DESCRIPTION

Figure 1:
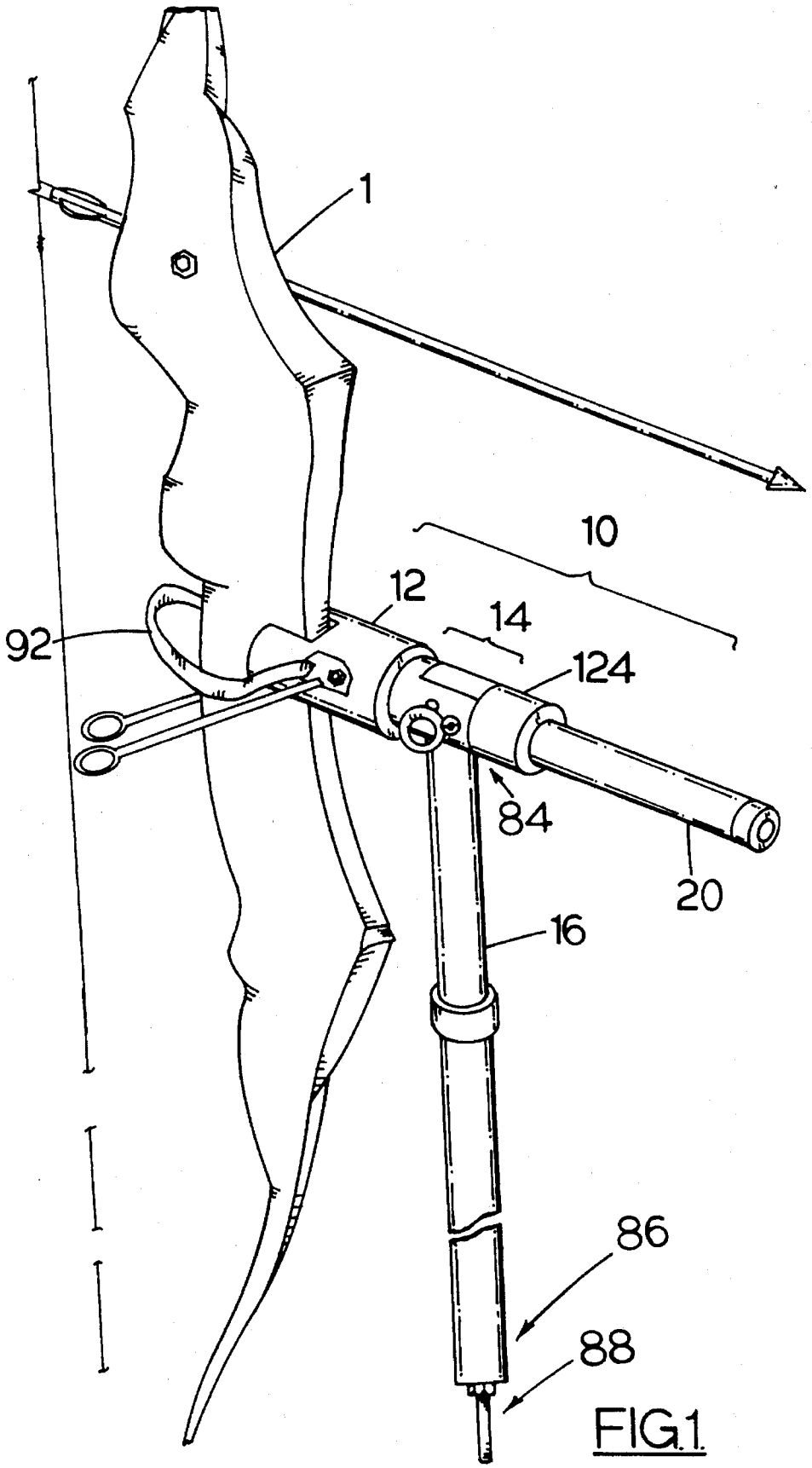
FIG. 1 is an isometric view showing one embodiment of the archery bow stabilizer and prop attached to a typical bow.
Figures 2, 3, 4, 4A, 4B, 5, 5A, 6:
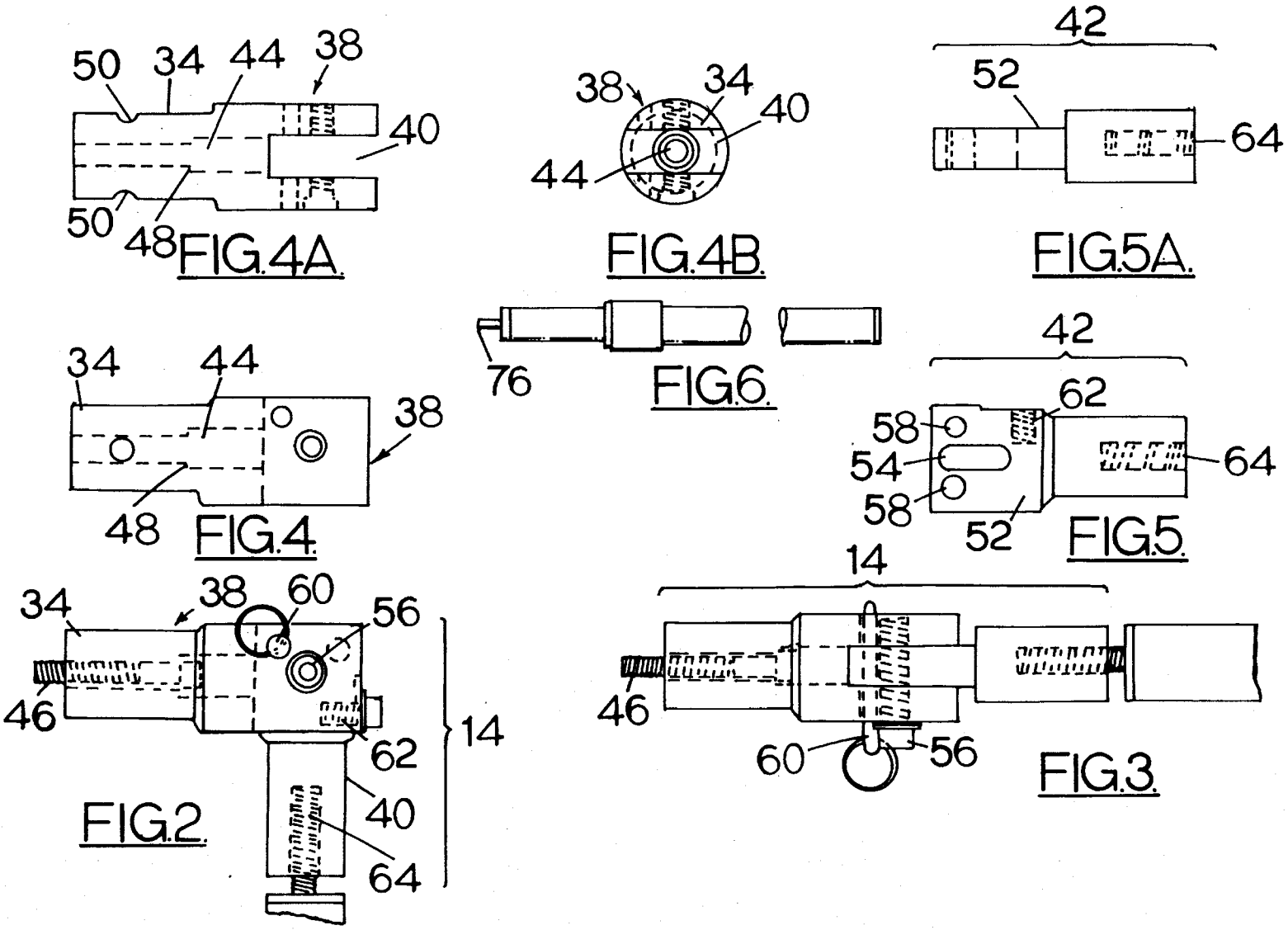
FIG. 2 is a side elevation view of the transition elbow, with the shaft and attached stabilizer-prop in a downward facing position.
FIG. 3 is a top view of the transition elbow with the stabilizer-prop in a horizontal position.
FIG. 4 illustrates a side view of one embodiment of the body of the transition elbow.
FIG. 4A is a top view of the body of the transition elbow.
FIG. 4B is an end view of the body of the transition elbow
FIG. 5 is a side view of the shaft of the transition elbow showing the flattened portion.
FIG. 5A is a top view of the shaft of the transition elbow showing the flattened portion.
FIG. 6 illustrates a side view of the stabilizer-prop.

Referring now to the drawings in general there is shown the preferred embodiments for the archery bow stabilizer and prop 10 of this invention.

The basic configuration of the archery bow stabilizer and prop 10 contains a stabilizer-prop 16, a transition elbow 14, and a means of mounting the archery bow stabilizer and prop to the bow 1.

The stabilizer-prop 16 in a simple form is an elongated rod of a predetermined length. The stabilizer-prop 16 attaches to the transition elbow 14 rather then directly to the bow. It can be used as either a stabilizer, bow prop or both, depending on the position on the transition elbow.

A typical stabilizer mounts horizontally to a bow 1 by screwing it into a threaded bore on the bow. The archery bow stabilizer and prop of this invention uses the same threaded bore on the bow 1 in place of the typical stabilizer. A typical stabilizer can be then attached to the transition elbow 14 if desired. In the alternative, the stabilizer-prop 16 can function as a stabilizer. The stabilizer-prop 16 can be mounted to the transition elbow 14 in a horizontal position to emulate a stabilizer. The stabilizer-prop 16 can also be attached to the transition elbow 14 in a lower position to function as a bow holder or prop. In this position, the archery bow stabilizer and prop holds the bow in a vertical ready position at a height determined by the height of the prop.

A typical stabilizer absorbs bow shock and vibration and assists in balancing the bow during shooting. It does this by placing a weight in front of the bow to counteract the weight towards the back of the bow when the bow is drawn. The weight of the stabilizer absorbs the recoil of the stopping bow string by having a greater mass at rest in an appropriate location.

The archery bow stabilizer and prop 10 provides the same advantages of the stabilizer. It does this by placing weight in front of the bow to assist in balancing and provides a greater mass at rest to absorb the recoil, bow shock and vibrations. This is true whether the stabilizer-prop 16 is in the horizontal or the vertical position.

The transition elbow 14 provides flexibility for the archer. It allows weight distribution and positioning of the stabilizer-prop and typical stabilizer at the discretion of the archer. The transition elbow 14 allows use with or without a stabilizer 20 and with or without the stabilizer-prop 16. As shown in FIG. 1, the archery bow stabilizer and prop is attached to a compound bow. The locking adapter 12 and transition elbow 14 is attached to a bow 1 at the location for attachment of the stabilizer 20. A stabilizer 20 is shown attached to a threaded bore at the end of the shaft of the transition elbow 14. The stabilizer-prop is attached to the downward facing threaded bore of the transition elbow. In this configuration the stabilizer-prop is functioning as a bow prop in addition of providing additional weight for stabilization. The stabilizer 20 could be removed if less weight is desired. The stabilizer-prop functions adequately in this regard.

The transition elbow 14 in one embodiment contains a pivoting shaft. This allows the position of the stabilizer-prop to pivot from a vertical position to a horizontal position. Some archers prefer that the stabilizer extend outward in a horizontal position. Others find shooting with the stabilizer-prop in the vertical position to be adequate. Some archer's have indicated shooting is better with the stabilizer-prop in the vertical position. The pivoting transition elbow allows the archer the ability to easily pivot from one to the other without the need of removing and attaching the stabilizer-prop.

Another configuration with the pivoting transition elbow is a typical stabilizer attached in a horizontal position and the stabilizer-prop attached to the vertical position. Then if the archer desires an extended stabilizer he can pivot the transition elbow 14 so that the stabilizer-prop extends outward in a horizontal position and the stabilizer is facing upward in a vertical position. The stabilizer sets in front of the bow 1 and does not interfere with the flight of the arrow.

The preferred embodiment and the best mode contemplated of the archery bow stabilizer and prop of the present invention are herein described. However, it should be understood that the best mode for carrying out the invention hereinafter described is offered by way of illustration and not by the way of limitation. It is intended that the scope of the invention include all modifications which incorporate its principal design features.

The archery bow stabilizer and prop 10 of the present invention consists basically of three or four main components depending on the specific embodiment. Some of which was discussed above. The three components of the preferred embodiment are locking adapter 12, transition elbow 14 and stabilizer-prop combination 16. In another embodiment, a mounting means 18 incorporates portions of the locking adapter 12 and a portion of the transition elbow 14. In either embodiment, the transition elbow 14 can be either stationary or pivotal.

Figure 7:
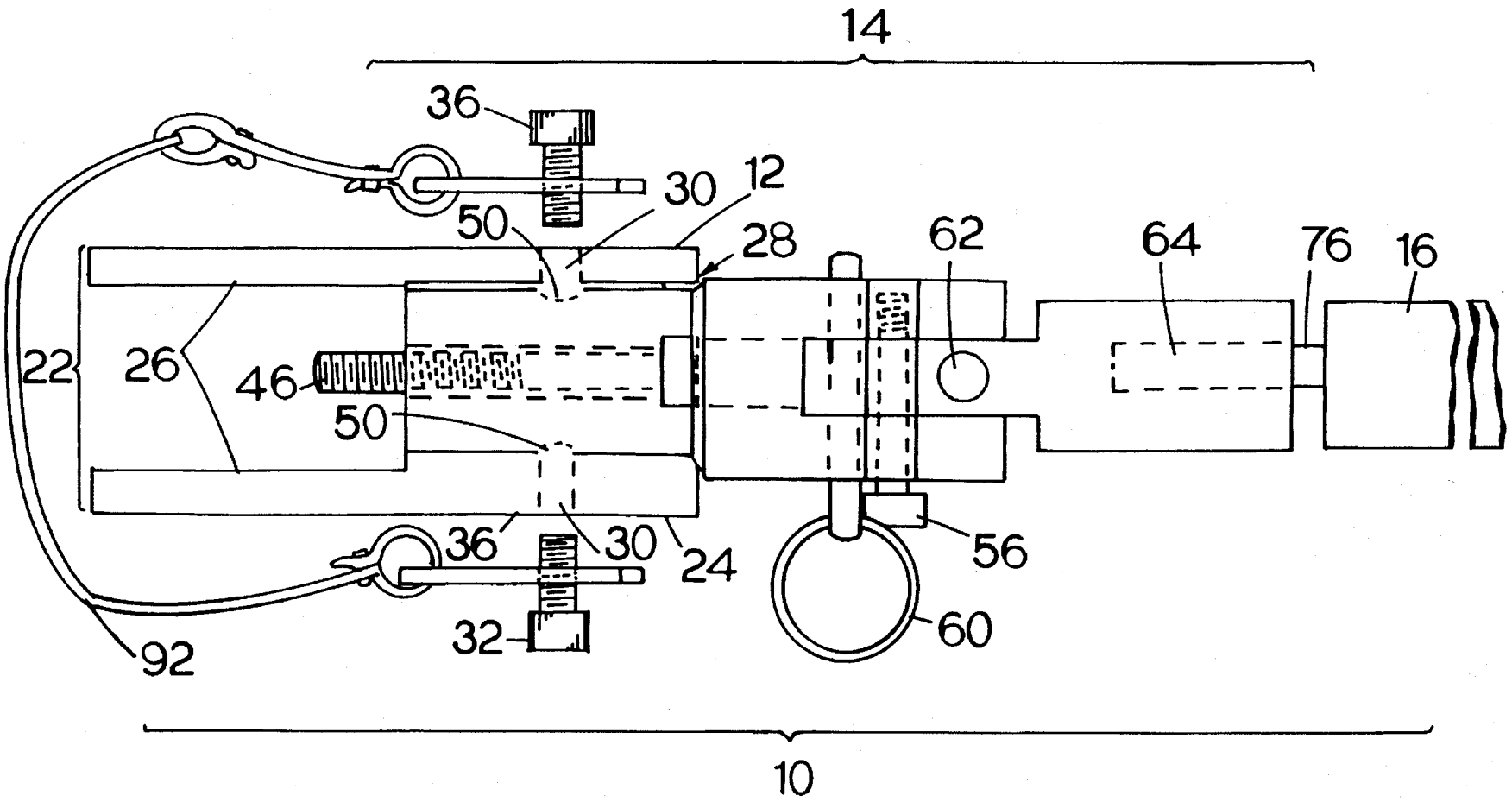
FIG. 7 is a top view showing the locking adapter of one embodiment with a wrist strap attached.

The locking adapter 12 is a bracket that functions as an anti-rotation device. A top view is illustrated in FIG. 7. The locking adapter 12 has a first end 22 and a second end 24. The first end 22 has parallel extensions 26 that fit over a handle of a bow 1. The second end has an opening 28 designed to receive the shank 34 of transition elbow 14. The opening 28 is defined by side walls 36 of the second end 24. A plurality of threaded holes 30 are contained on the side walls 36 on the second end 24. The threaded holes receive locking bolts 32. The locking bolts 32 locks the transition elbow 14 in the locking adapter 12.

In the preferred embodiment, the locking adapter is made of aluminum. Aluminum provides strength, durability yet is light in weight. Other materials could also be used without departing from the scope and spirit of the inventive concepts herein disclosed. In one embodiment and the best mode contemplated, the locking adapter 12 is made from a cylindrical block 1.5 inches in diameter and an overall length of 3 inches. The parallel extensions 26 are separated by approximately 1.05 inches. This width is sufficient to fit over the handle of a bow 1. The extensions 26 fit over the bow handle to prevent the archery bow stabilizer and prop 10 from rotating on the bow 1. The opening 28 is centered in the second end 24 and has a diameter of approximately 0.86 inches. Other dimensions could also be used as necessary to accommodate different materials, bows or configurations. Typically, there will be two threaded bores 30 exactly across from each other and in alignment. The threaded bores 30 are typically, tapped to receive a ¼ inch locking bolt 32. The locking bolts 32 tighten against the shank 34 to lock the transition elbow 14 in the locking adapter.

There are two types of transition elbows 14. There is a stationary type illustrated in FIG. 9 and a pivotal type illustrated in all other figures.

The transition elbow 14, in the pivotal type, consists of a body 38 and a shaft 42. The body 38 is attachable to the second end 24 of the locking adapter 12. The body 38 in this embodiment has a shank 34 that fits within the opening 28 in the locking adapter 12. The body 38 of the transition elbow 12 has a slotted opening 40 opposite of the shank 34. The slotted opening 40 receives the shaft 42 of the transition elbow 14.

A longitudinal bore 44 extends through the body 38 for receiving a bolt 46. The bolt 46 attaches and secures the archery bow stabilizer and prop 10 to the bow 1. The longitudinal bore 44 extends through the shank 34 from the slotted opening 40. The longitudinal bore 44 typically has two diameters to create an internal ledge 48. The internal ledge 48 provides a means of stopping the head of bolt 46 from going completely through the longitudinal bore 44.

To mount the archery bow stabilizer and prop 10 to a bow 1, the bolt 46 is inserted into the longitudinal bore 44 from the slotted opening 40 on the transition elbow 14. The shank is inserted into the opening 28 on the locking adapter 12. The parallel extensions 26 are place over the handle of the bow 1 with the bolt 46 aligned with the threaded bore on the bow 1. The bolt 46 is tightened in the threaded bore typically using a hex wrench until secure. The slotted opening is properly aligned and the locking bolts 32 are then tightened against the shank 34 of the transition elbow 14 to lock the transition elbow 14 to the locking adapter. The shank 34 typically contains dimples 50 for receipt of the ends of locking bolts 32. The locking bolts 32 extending into the dimples 50 prevents the transition elbow 14 from rotation within the locking adapter 12.

The shaft 42 will have a flattened portion 52 that fits within the slotted opening 40 in the body 38 of the transition elbow 14. In the pivotal type, the flattened portion 52 contains an elongated bore 54. When the flattened portion 52 is installed within the slotted opening 40, a pivot pin or bolt 56 extends through a bore on the sides of the slotted opening 40 through the elongated bore 54. This arrangement allows the shaft 42 to pivot on the body 38. The elongated bore 54 is necessary to provide clearance of the edges of the shaft 42 when pivoting the transition shaft 42 from a vertical position to a horizontal position and visa versa. A pair of locking holes 58 will be located on the flattened portion 52 with one on each side of the elongated bore 54. These will be positioned to receive a locking pin 60. The locking pin 60 extend through another bore on the sides or the slotted opening 40 through one of the locking holes 58. The shaft 42 pivots from a horizontal position to a vertical position. The locking pin 60 locks the shaft 42 in one position or the other.

The shaft 42 will also have a first threaded bore 62 and a second threaded bore 64. These threaded bores 62 and 64 are in a perpendicular relationship to each other. The first threaded bore 62 is generally positioned on the side of the shaft 42, and typically on an edge of the flattened portion 52, such that when a stabilizer or the stabilizer-prop is attached they will pivot in alignment with the bow 1. The second threaded bore 64 is located at the end of the shaft 42 on the opposite end of the flattened portion 52. The threaded bores 62 and 64 receive either a stabilizer 20 or the stabilizer-prop 16.

The transition elbow 14 is also made of aluminum with dimensions appropriate to the locking elbow 12. In the best mode contemplated, the body 38 has a length of approximately 3.31 inches. The shank 34 will have a diameter to snugly fit within the opening 28 on the locking adapter 12. Therefore, the shank 34 will have a diameter slightly less then 0.86 inches. The shank 34 will have a length of approximately 1.5 inches that corresponds to the depth of the opening 28 in the locking adapter 12. The slotted opening 40 on the body 38 will have a width of approximately 0.5 inches as will the flattened portion 52 of the shaft 42. The depth of the slotted opening 40 is approximately 1.25 inches and the length of the flattened portion 52 is slightly greater being at approximately 1.6 inches.

Figure 2A:
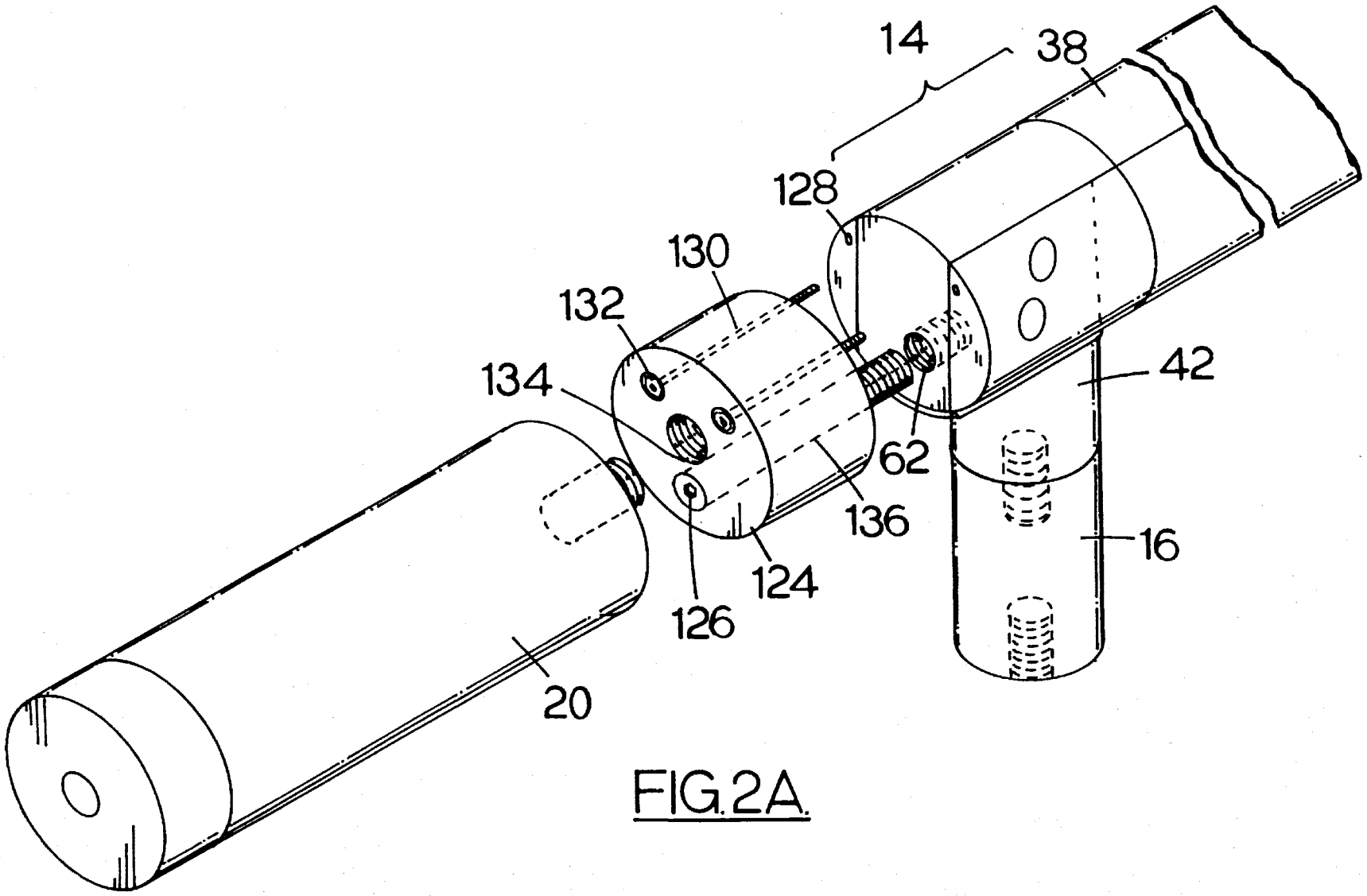
FIG. 2A is an isometeric view of the transition elbow showing an exploded view of the centering attachment attachable to the transition elbow in the first threaded bore.

FIG. 2A illustrates the transition elbow 14 with the shaft 42 pivoted in a downward position. The stabilizer-prop functions as a stabilizer in this position. A stabilizer 20 is also shown. An additional piece is shown between the stabilizer 20 and the transition elbow 14. This piece is a centering adapter 124. The first threaded bore 62 on the shaft 42 may not be centered on the transition elbow 14. Because of the elongated bore 54, the first threaded bore 62 may be placed so as not to interfere with pivoting the shaft 42. If it were centered, the threaded rod 76 on the end of the stabilizer-prop 16 would extend into the elongated bore 54.

The centering adapter 124 is a cylindrical plug having an off centered bore 136. The centering adapter 124 is positioned in alignment with the body 38 of transition elbow 14. The off centered bore 136 aligns with the first threaded bore 62 on the transition elbow 14. A bolt 126 is inserted through the off centered bore 136 and screwed into the first threaded bore 62 to secure the centering adapter 124 to the transition elbow 14.

A third threaded bore 134 on the centering adapter 124 then functions as the first threaded bore 62. The third threaded bore 134 is centered on the centering adapter 124. The purpose of the centering adapter 124 is to allow a stabilizer 20 or the stabilizer-prop 16 to be attached in a center position on the transition elbow. Without the centering adapter 124 the stabilizer or stabilizer-prop 16 would set below center. This does not interfere with the functioning but rather provides a more pleasing appearance and perhaps less of a distraction to the archer.

Alignment bores 128 in transition elbow 14 and alignment bores 130 in the centering adapter 124 in conjunction with alignment pins 132 may also be used to provide additional means of holding the centering adapter 124 in a centered position and to prevent rotation.

Figure 9A:
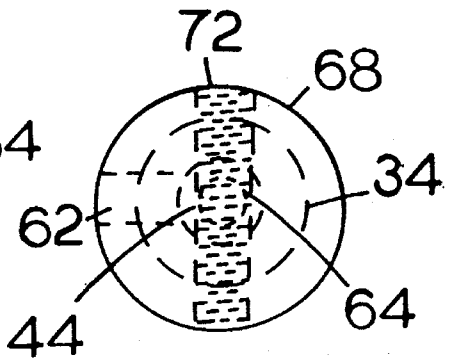
FIG. 9A is an endview of the stationary or fixed transition elbow.
Figure 9:
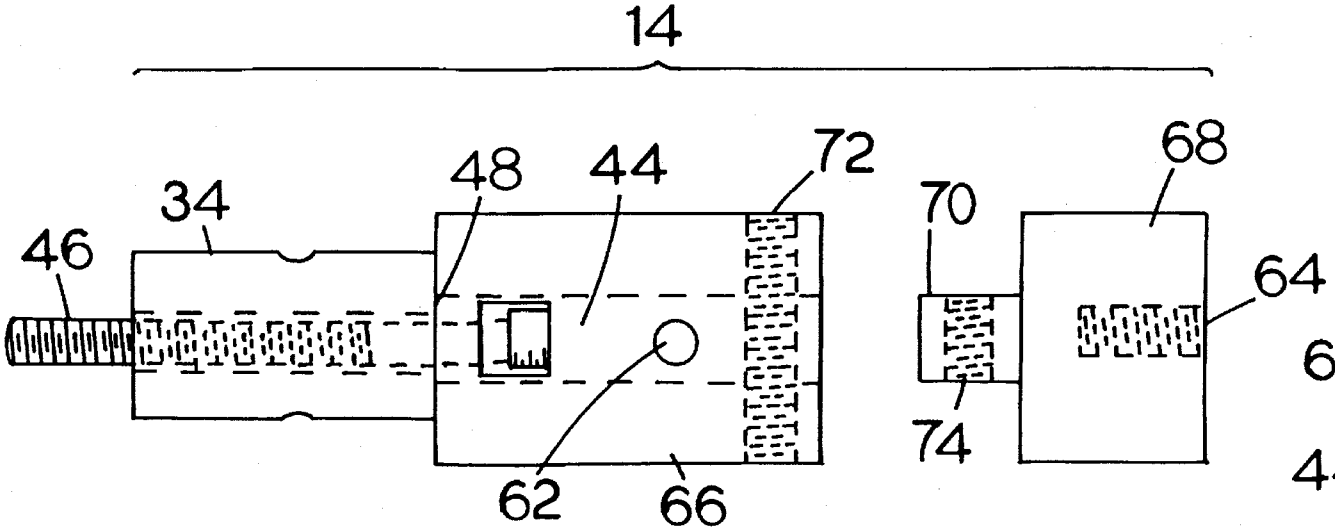
FIG. 9 is an illustration of the stationary or fixed transition elbow, showing the body and the fixed insert.
Figure 10:
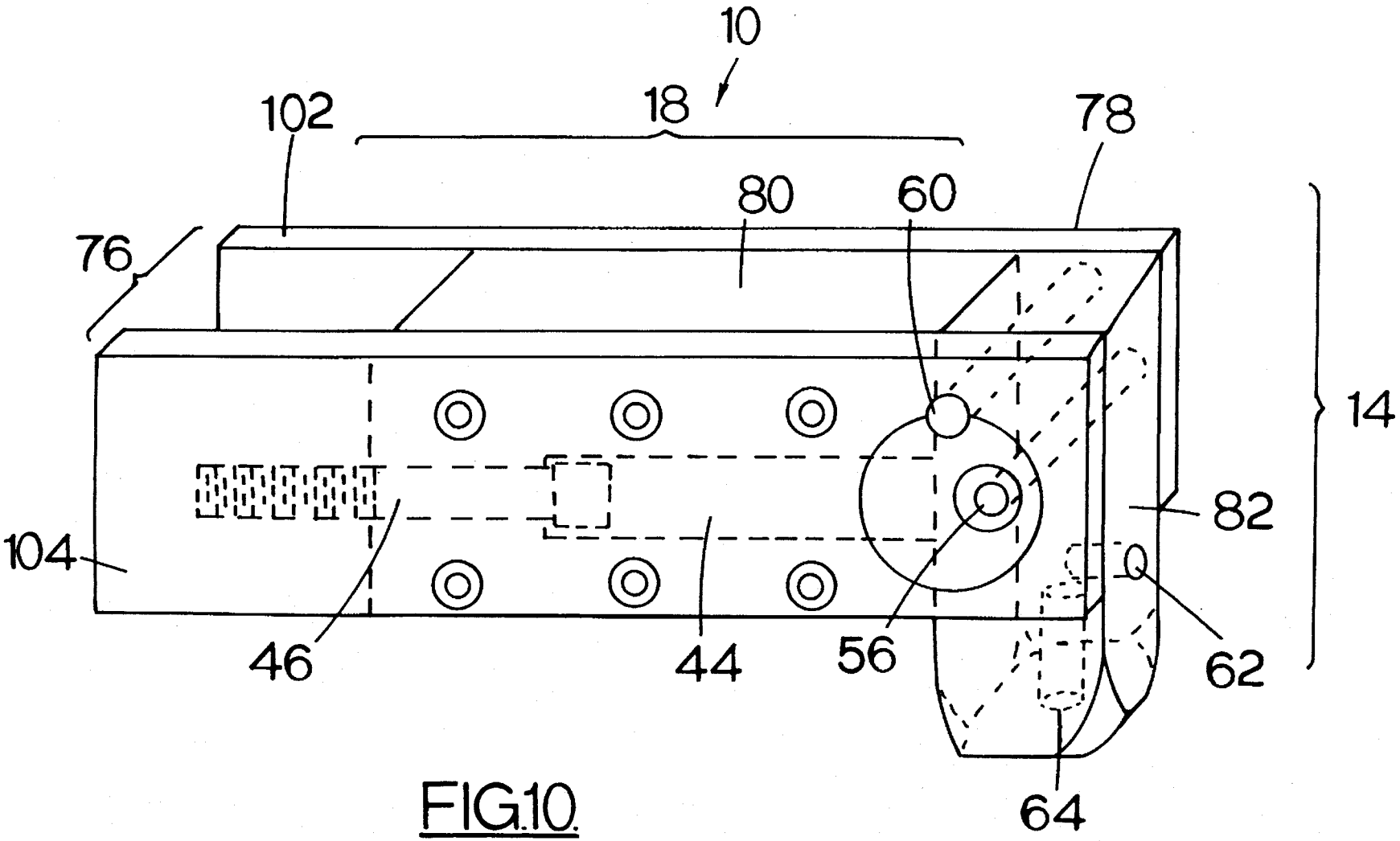
FIG. 10 is an isometric view illustrating a second embodiment of the archery bow stabilizer and prop.
Figure 11:
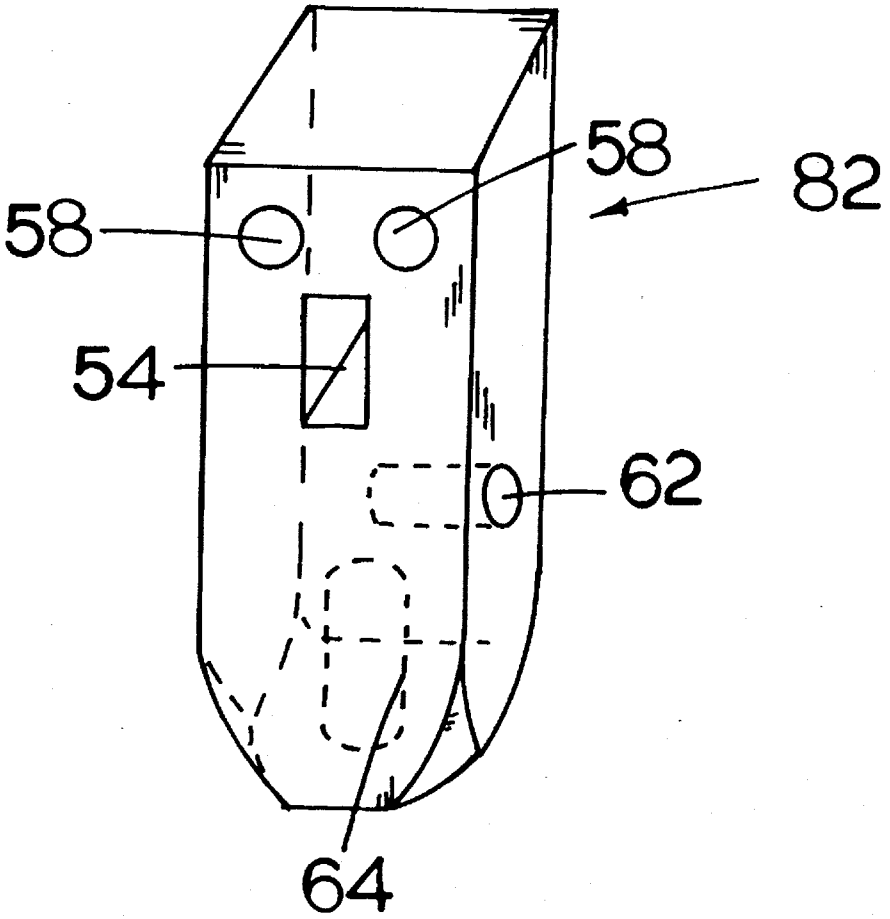
FIG. 11 is an isometric view of the shaft portion of the transition elbow for the second embodiment.

Referring now to FIG. 9, the stationary type of transition elbow 14 is described. The transition elbow 14 has a shank 34 similar to the previous description. The main body area 66 differs in that there is no slotted opening 40. The longitudinal bore 44 extends completely through the body area 66 as well as through the shank 34. The internal ledge 48 is maintained to stop bolt 46. The shaft 42 is replaced with stationary plug 68. The stationary plug 68 has a male extension 70 that fits within the longitudinal bore 44. A threaded bore 72 extends through the body area 66 and the longitudinal bore. A bolt (not shown) is screwed through the threaded bore. A bore 74 extends through the male extension 70, which aligns with the threaded bore 72. The bolt locked the stationary plug to the body area 66.

A portion body and the exposed end of the stationary plug 68 comprises an attachment area. The attachment area contains the first and a second threaded bores 62 and 64. These bores 62 and 62 are in perpendicular relationship to each other. An attachment means 76 on the stabilizer-prop 16 is attachable to the first threaded bore 62 for vertical position of the stabilizer-prop 16 for use as a bow prop. The stabilizer-prop is attachable in the second threaded bore 64 for horizontal position of the stabilizer-prop 16 for use as a stabilizer.

Figure 8:
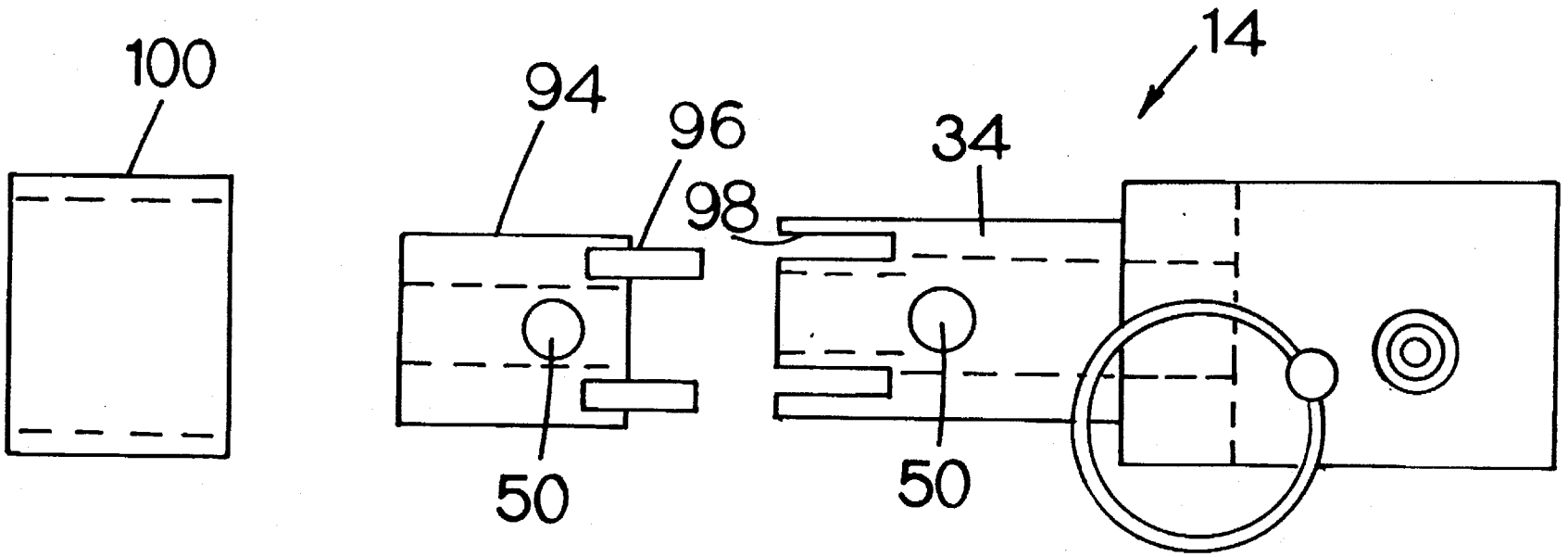
FIG. 8 is a side view of the body of one embodiment of the transition elbow showing an extension attachable to the end and a sleeve that fits over the shank.

The stabilizer-prop 16 when in the vertical position extends downward from the transition elbow 14. The front of the bow 1 extends outward further then the handle area. Therefore, the stabilizer-prop 16 must clear the front of this extended area of the bowl. The length of the locking adapter 12 and transition elbow 14 must be sufficient to hold the stabilizer-prop 16 out from this extended area of the bow. The dimensions given for the preferred embodiment and best mode contemplated holds the stabilizer-prop approximately 2.75 inches from the bow handle. This length is sufficient for the majority of bows. However, a few bows require a greater length. Referring now to FIG. 8, an extension 94 is made to extend the length another inch. The extension 94 attaches to the end of shank 34. Alignment pins 96 may be used which are inserted into apertures 98. A sleeve 100 would slide over the shank 34 to properly position the transition elbow 14 within the opening 28 on the locking adapter. Dimples 50 for receiving the ends of locking bolts 32 would be used to prevent rotation. The bolt 46, when using the extension 94 would also have to be 1 inch longer.

Another embodiment combines the locking adapter 12 and the body portion 38 as a single unit. The single unit consists of a mounting means 18 that attaches the archery bow stabilizer and prop 10 to the archery bow 1. A simple description of the mounting means in the preferred embodiment and best mode contemplated is an elongated H shaped block. The H shaped block has a first set of parallel arms 76 making a bow mounting end and a second set of parallel arms 78 making a transition elbow mounting end. The first set of parallel arms 76 resembles the parallel extensions 26 on the locking adapter 12. A center region 80 of the mounting means 18 is a block separating the parallel arms 76 and 78. A longitudinal bore 44 extends from the transition elbow mounting end to the bow mounting end for inserting a bolt 46. Bolt 46 attaches and secures the mounting means 18 to the bow 1.

The first set of parallel arms 76 on the bow mounting end slip over the handle of bow 1. The first set of parallel arms 76 prevent the archery bow stabilizer and prop from rotating on the bow 1. This is similar to the parallel extensions 26. The second set of parallel arms 78 functions as the slotted opening 40 on the body portion 38 of the transition elbow 14. A transition elbow shaft 82 is installed and fits between the second set of parallel arms 78.

The transition elbow shaft 82 is similar to the shaft 42 as described above. The transition elbow shaft 82 is generally a rectangular block sized to fit between the second set of parallel arms 78. An elongated bore 54 and a pair of locking bores are contained on the transition elbow shaft 82 just as on the shaft 42. A pivot pin or bolt 56 extends through bores on the second set of parallel arms 78 and through the elongated bore 54. The transition elbow shafts 82 pivots about the pivot pin or bolt 56. The elongated bore 54 provides clearance when the transition elbow shaft 82 pivots. A locking pin 60 extends through another bore through the second set of parallel arms 78 and through the bores 58 on the transition elbow shaft 82, to lock the transition elbow shaft 82 in a first position or a second position.

A first threaded bore 62 and a second threaded bore 64 are contained on the transition elbow shaft 82 just as on the previous described transition elbow. The threaded bores 62 and 64 are in a perpendicular relationship to each other. The first threaded bore 62 is generally positioned on the side of the transition elbow shaft 82, such that when a stabilizer 20 or the stabilizer-prop 16 is attached they will pivot in alignment with the bow 1. The second threaded bore 64 is located at the end of the transition elbow shaft 82. The threaded bores 62 and 64 receive either a stabilizer 20 or the stabilizer-prop 16 as described above.

A stationary plug (not shown) resembling stationary plug 68 could also be used to make a stationary transition elbow 14. In this embodiment, the stationary block would simply be rigidly secured between the second set of parallel arms 78 by a bolt.

The mounting means 18, in one embodiment and best mode contemplated, is made with two strips 102 and 104 of aluminum stock. The strips 102 and 104 are mirror images of each other. Dimensions are approximately 1 inch wide, 0.25 inched thick and having a length of 4.5 or 5.5 inches. The differences in length provide clearance between the front of the bow and the stabilizer-prop 16 when the stabilizer-prop is in the vertical position. Most bows 1 only require the shorter version. However, a few will require the longer. The center portion 80, being a block separating the strips 102 and 104, is approximately 1 inch by 1 inch. The length will be either approximately 2 inches in the shorter version or 3 inched in the longer version. The transition elbow shaft 82 is approximately 1 inch by 1 inch and having a length of approximately 1.2 inches. The end of the transition elbow shaft 82 having the second threaded bore 64 may be tapered or rounded to make a more pleasing appearance.

Figure 18:
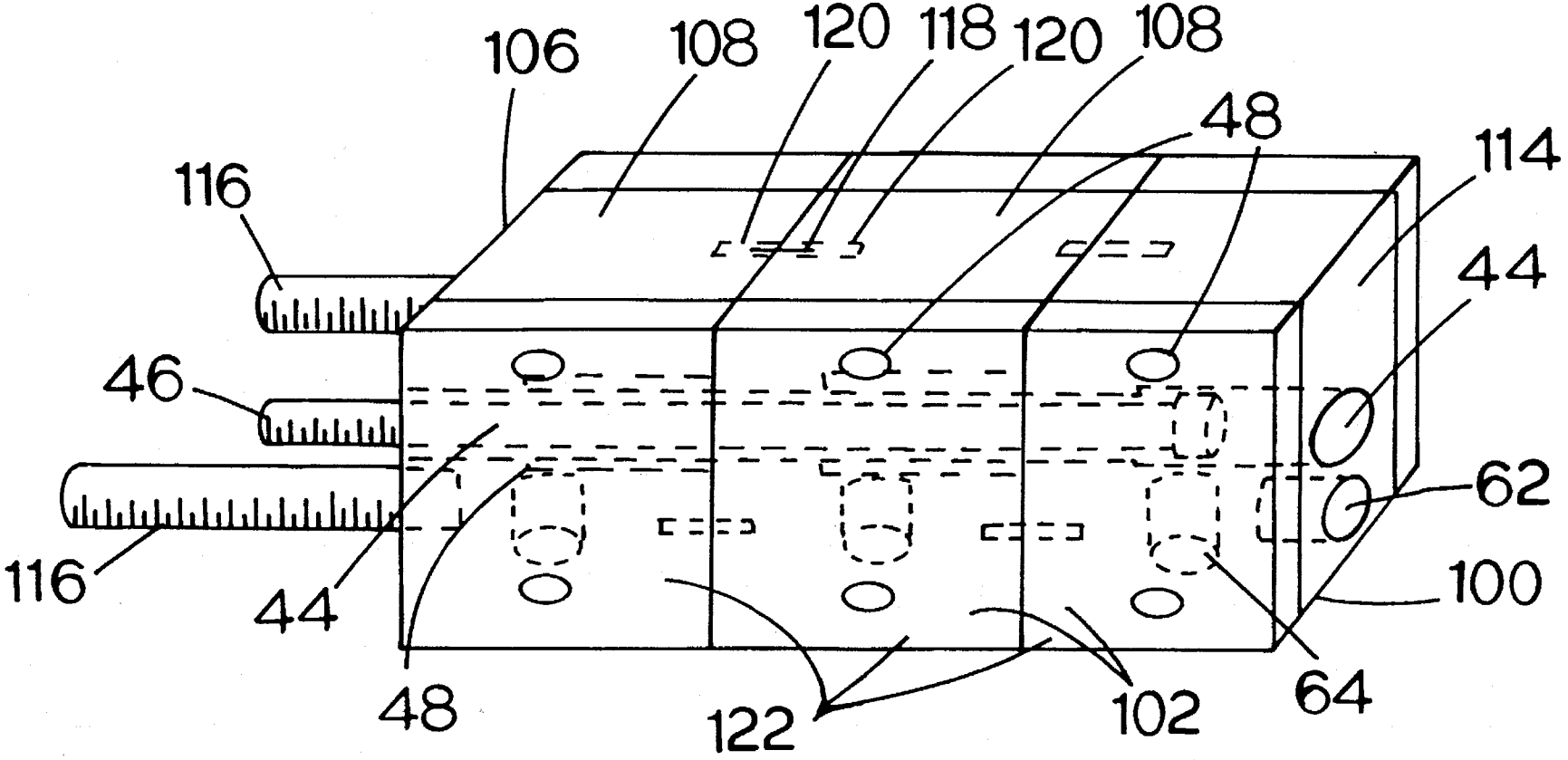
FIG. 18 is an isometeric view of a plurality of generic mounting blocks being a third embodiment of the archey bow stabilizer and prop.
Figure 19:
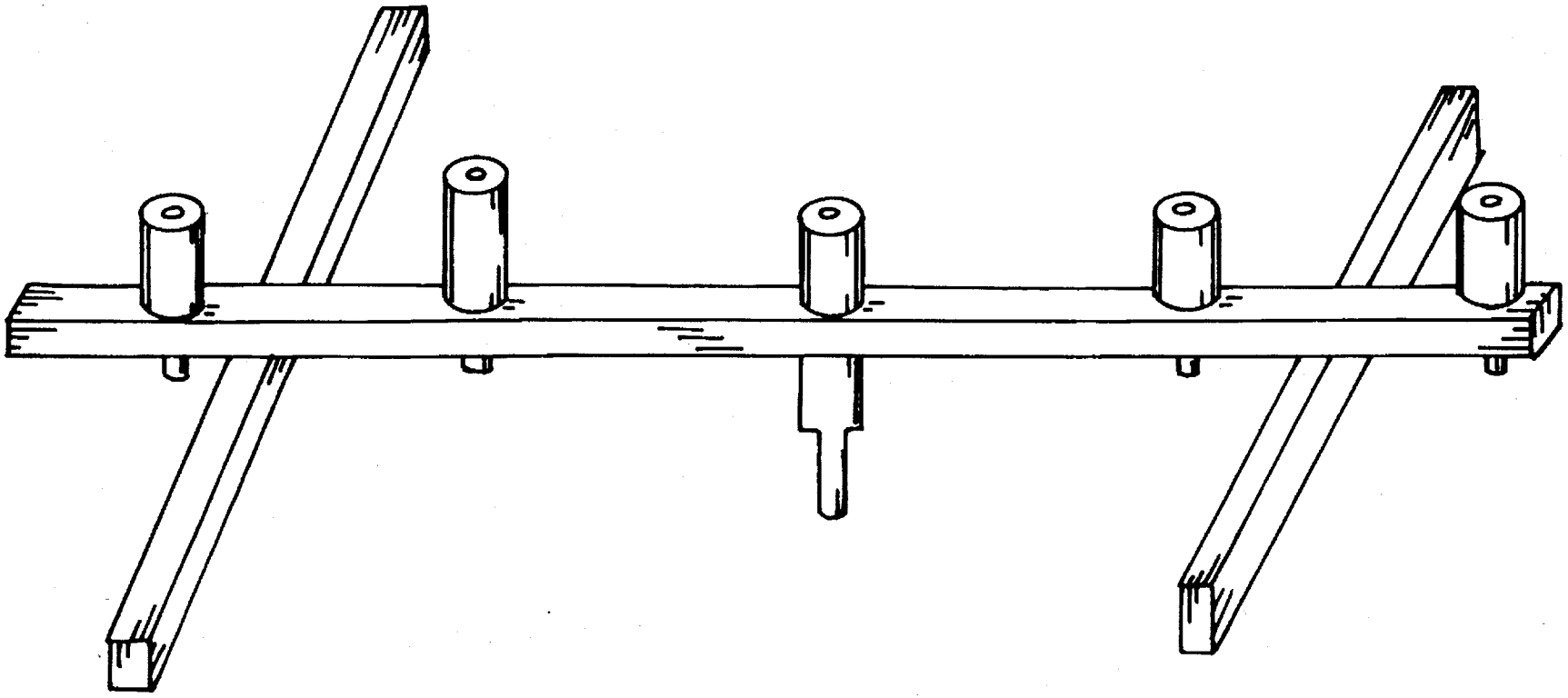
FIG. 19 illustrates a reciever designed to recieve a plurality of stabilizer-prop to hold a plurality of bows in a vertical position.

A third embodiment, and the most simple, of the archery bow stabilizer and prop 10 is illustrated in FIG. 18. The archery bow stabilizer and prop 10, in the third embodiment, consists of a generic mounting block 122. In the preferred embodiment, the generic mounting block 122 can generally be described as a rectangular cubical block. This embodiment combines the transition elbow 14 of the stationary type shown in FIG. 9 and the locking adapter 12 as a single unit. The rectangular block is typically made of aluminum, but could be made of other suitable material. In the best mode contemplated, the generic mounting block 122 measures approximately 1.5 inches by 1.5 inches by 1.5 inches.

The six surfaces of the generic mounting block 122 are referred to as a bow face 106, top face 108, bottom face 110, side faces 112 and forward face 114. A longitudinal bore 44 extends through the generic mounting block 122 from the forward face 114 to the bow face 106. The longitudinal bore 44 has two diameters, just as described above, to create a ledge 48 within the bore 44. A bolt 46 is inserted into and extends through the generic mounting block 122 to attach and secure the generic mounting block 122 to the archery bow.

Anti-rotation arms 116 substitute for the parallel extensions 26 on the locking adapter 12. A pair of anti-rotation arms 116 in a parallel spaced relationship are used. The anti-rotation arms 116 fit over the handle of the bow 1 to prevent rotation of the archery bow stabilizer and prop 10. The anti-rotation arms 116 are attached to the bow face 106 on the generic block. In the preferred embodiment, these are pressed into bores located on the bow face 106. They could also be screwed into threaded bores, welded or attached in any other known means in the art.

The first threaded bore 62 is located on the forward face 114 on the generic mounting block 122. The second threaded bore 64 is located on the bottom face 110 on the generic mounting block 122. Just as described above the second threaded bore 64 is in a perpendicular relationship with the first threaded bore 62.

The stabilizer-prop 16 attaches to either the first or second threaded bore 62 and 64. The stabilizer-prop 16 would be in a horizontal position when attached to the first threaded bore 62 to function as a stabilizer. The stabilizer-prop 16 would be in a vertical position when attached to the second threaded bore 64 to function as a bow prop. The second end of the stabilizer-prop 16 would rest directly upon a hunting surface or within a receiver 90 to support the archery bow in a vertical and ready position. As indicated above, the stabilizer-prop 16 would hold the bow at a predetermined height.

The generic mounting blocks 122 are designed to be used individually or in plurality to provide clearance between the front of the bow the stabilizer-prop when attached to the seconded threaded bore 64. Each of the generic blocks are identical so an archer can attach as many or as few as required for the application. The plurality of the generic mounting blocks 122, when attached, are aligned with the forward face 114 attached to the bow face 106 of a next generic mounting block 122. As illustrated, three generic mounting blocks 122 are used. However, as few as one can be used and as many can be used as needed to provide the required clearance. The only difference is a longer length bolt 46 must be used to attach and secure the plurality of generic mounting blocks 106 to the archery bow 1.

When a plurality of generic mounting blocks 122 are joined alignment pins 118 may be used. The alignment pins 118 are inserted in opposing alignment holes 120 in the bow face 106 and the forward face 114. The alignment pins 118 hold the generic mounting blocks 122 in alignment and preventing the generic mounting blocks 122 from rotating about each other.

A stabilizer-prop 16 in the most simple embodiment is a single length staff of predetermined length. The length would be determined by the specific needs of the archer. The length would typically be such that the stabilizer-prop 16 holds the bow 1 at a desired height. The height could be for holding a bow 1 at a ready position when in a standing position or a sitting position. Or for assisting an archer with physical disabilities, the height might be for holding a bow 1 at a height of the bow if held at an arms length for shooting.

The stabilizer-prop 16 generally has a first end 84 and a second end 86. The first end 84 will typically have a threaded rod 76 that screws into threaded bores 62 or 64 on the transition elbow 14. The stabilizer-prop 16 extends outward in a horizontal position for use as a stabilizer when attached to the first threaded bore 62. The stabilizer-prop 16 extends downward in a vertical position for the stabilizer-prop 16 to function as a bow prop when attached to the second threaded bore 64.

In the preferred embodiment, and as shown on FIG. 1, the stabilizer-prop 16 is telescoping staff. The telescoping staff is lockable at any position between a low position and a high position. The use of a telescoping staff provides length adjustment of when used as a stabilizer, or for height adjustment when used as a prop. This arrangement provides a greater versatility for the archer. The same stabilizer-prop 16 can be used at several different height. This eliminates the need for several different sizes of stabilizer-props 16 needed by an advent archer.

Another embodiment for the stabilizer-prop 6 is a three piece extendable and collapsible telescopic staff. The staff would also be lockable in any position between a close in position and a far out position. The three piece telescopic staff in the collapsed position would have a length less then maximum allowed for competition shooting. Generally, competition rules prevent stabilizers from extending more then one foot from the front of the bow.

The second end 86 of the stabilizer-prop 16 in one embodiment contains a spike 88. The spike 88 could be inserted into the earth or into an opening on a receiver 90. The spike 88 when inserted into the earth or other soft hunting surfaces holds the archery bow 1 in an upright ready position.

Figure 14:
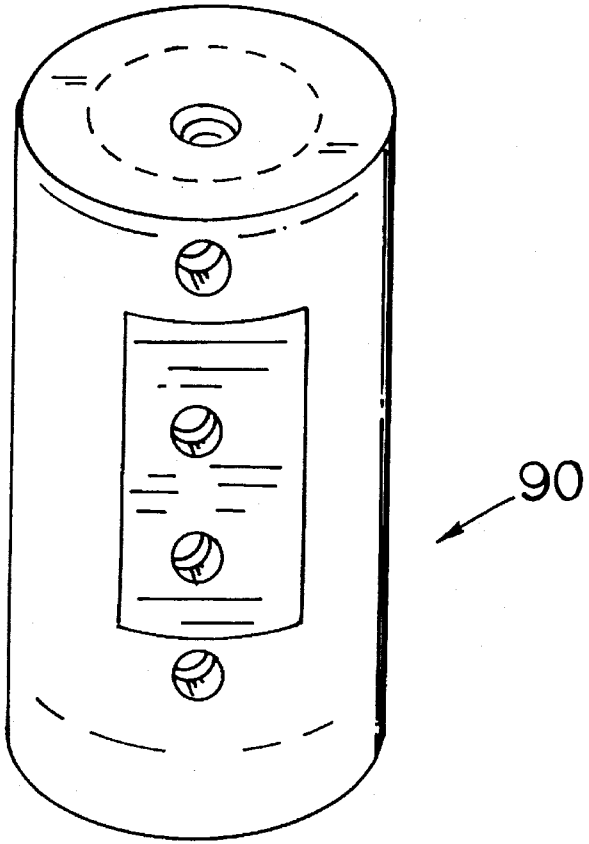
FIG. 14 illustrates a cylinder type receiver for receiving a second end of the stabilizer-prop, that is attachable to a surface such as a tree trunk.
Figure 12:
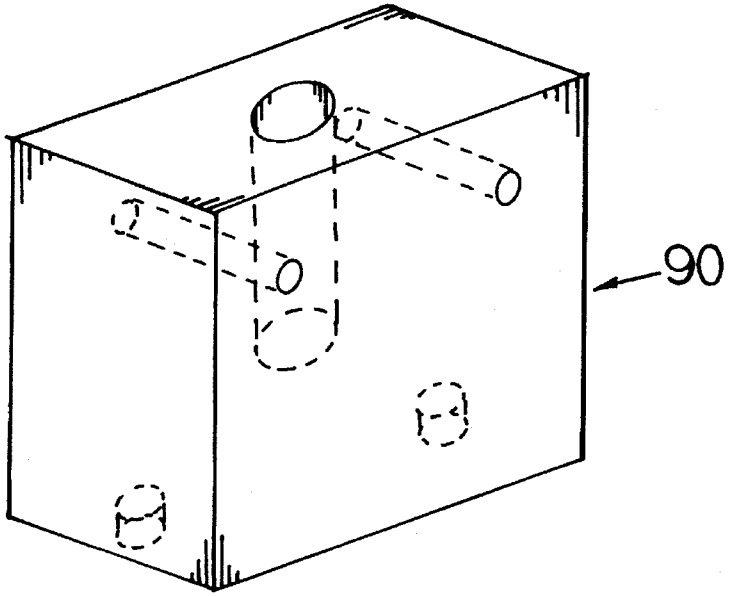
FIG. 12 illustrates a block type receiver for receiving a second end of the stabilizer-prop.
Figure 13:
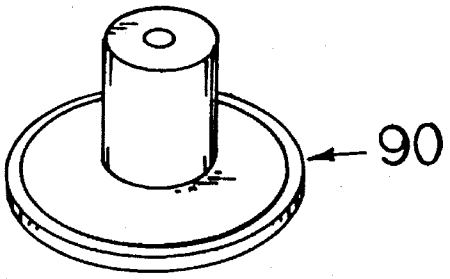
FIG. 13 illustrates another receiver having a cylindrical block mounted to a plate, with the cylinder having a hole for receiving a spike on the second end of the stabilizer-prop.
Figure 16:
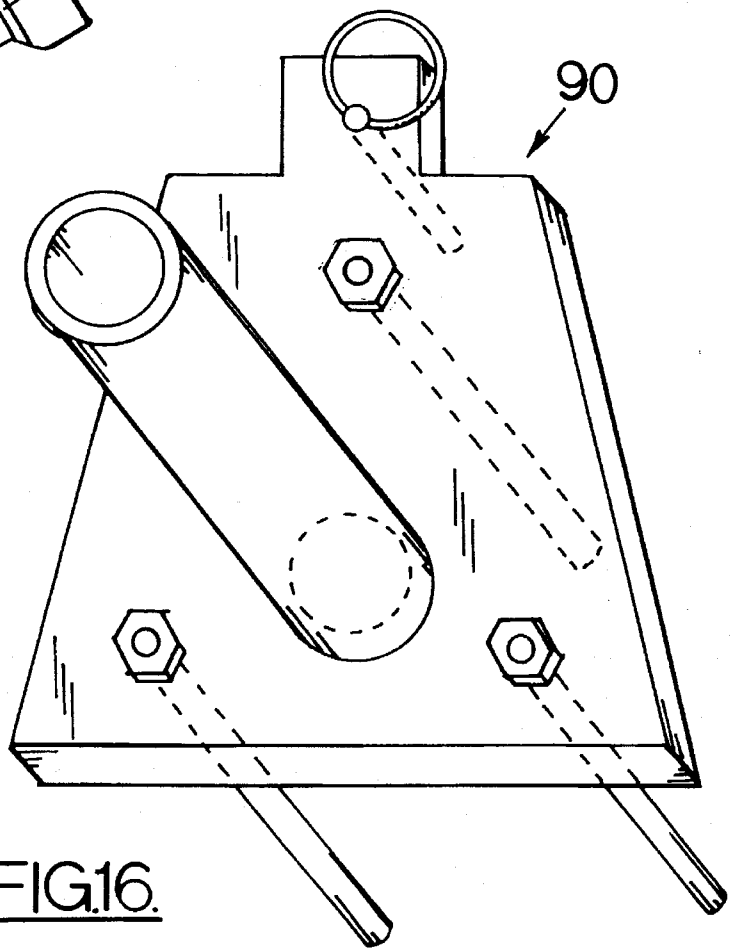
FIG. 16 illustrates another type of ground type receiver for receiving a second end of the stabilizer-prop.
Figure 15:
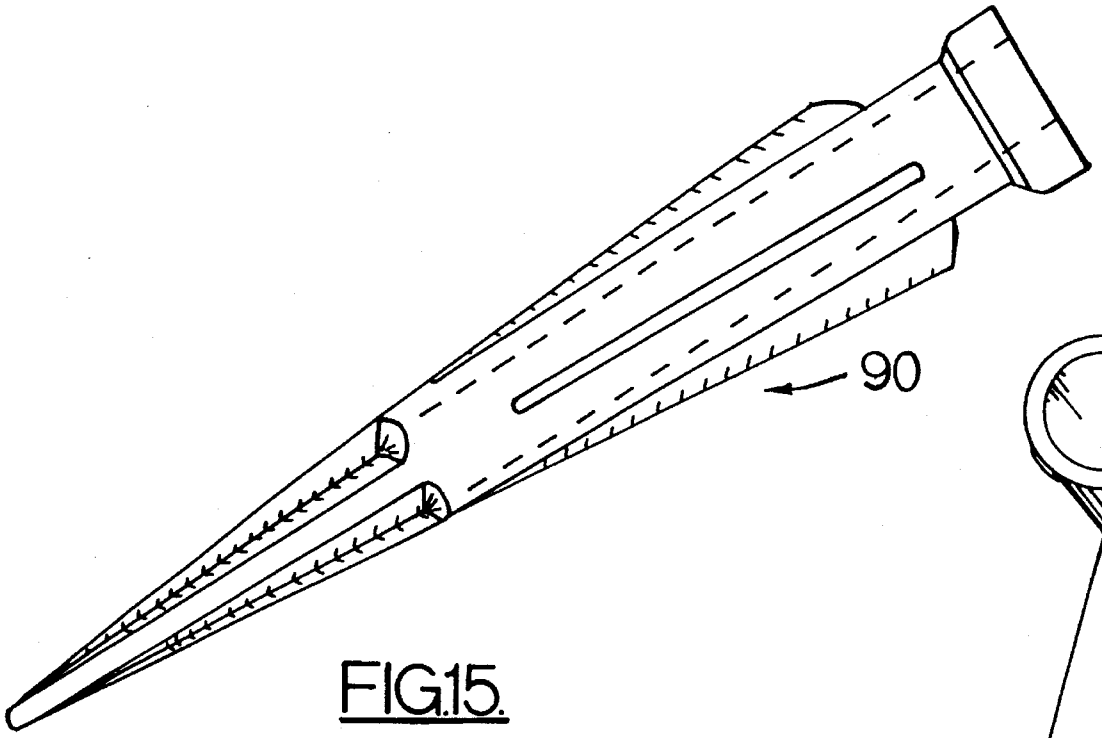
FIG. 15 illustrates a typical ground stake type receiver for receiving a second end of the stabilizer-prop.

The second end 86 of the stabilizer-prop 16 is generally designed to be inserted into a receiver 90. The receiver can consist of several different designs. FIGS. 12–16 illustrate several embodiment of receivers 90. FIG. 12 is illustrates a block type receiver for receiving a second end 86 of the stabilizer-prop 16 The block could be attached to a tree, a tree stand or any other hunting surface. FIG. 13 illustrates another receiver 90 having a cylindrical block mounted to a plate. The cylinder has an opening sized to receive spike 88 on the second end 86 of the stabilizer-prop 16. FIG. 14 illustrates another cylinder type receiver 90 attachable to a tree trunk or other hunting surface. FIG. 15 illustrates a typical ground stake type receiver 90. This type of receiver is typically used to hold a flag pole or other similar type items. FIG. 16 illustrates another type of ground type receiver 90 having a plurality of ground isertable spikes. This is especially useful on soft ground where additional support may be required.

Figure 17:
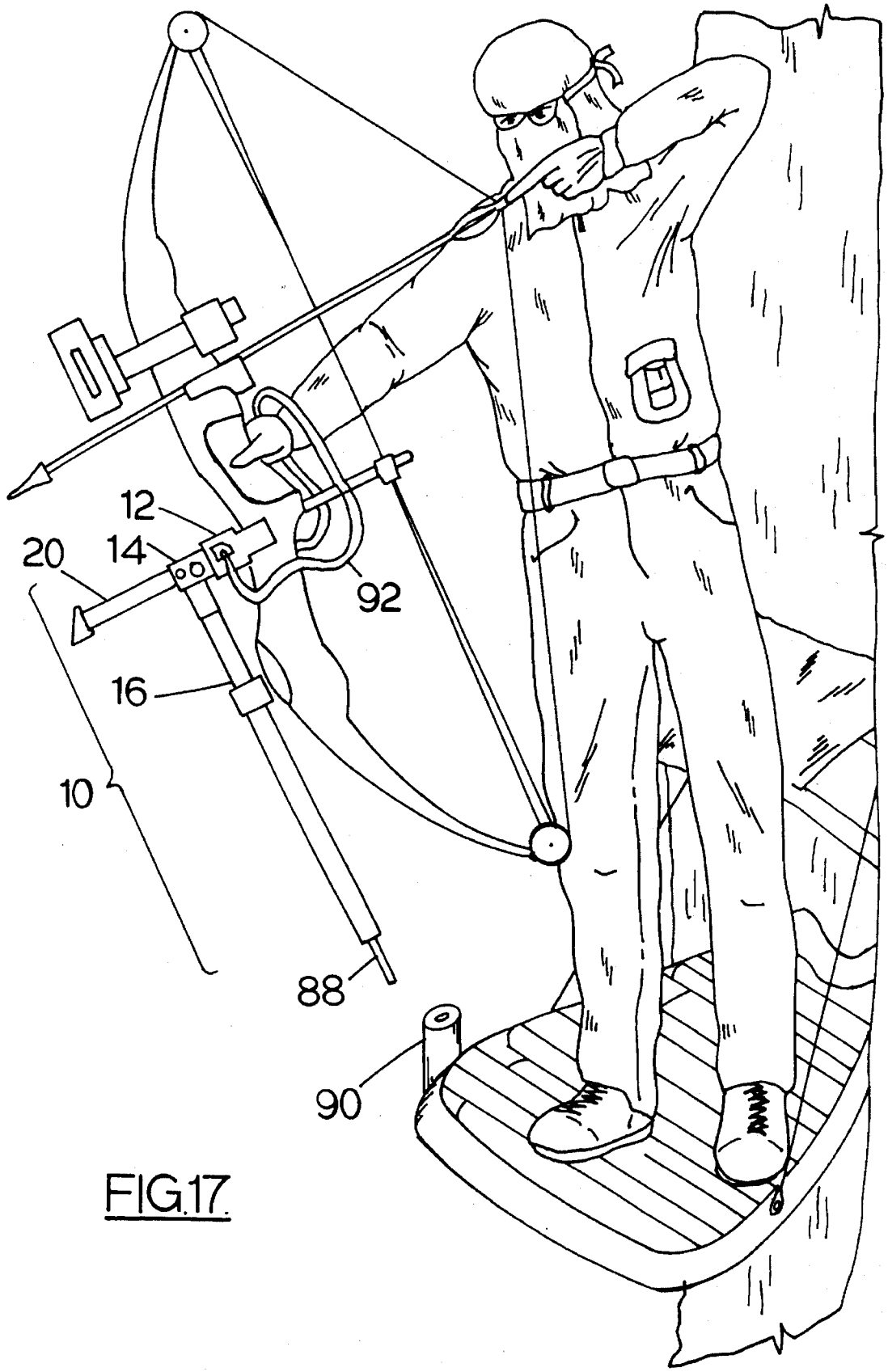
FIG. 17 illustrates an example of a typical application of the archery bow stabilizer and prop.

A wrist strap 92 can also be used in conjunction with the archery bow stabilizer and prop 10 of this invention. FIGS. 1, 7 and 17 illustrate use of the wrist strap 92. When shooting a bow, an archer uses open fingers to hold the bow. The open fingers help to prevent movement of the bow when aiming and shooting. Since the archer does not grasp the bow, the bow can be dropped after the arrow is shoot. The wrist strap 92 provides a means of retaining the bow 1. As illustrated the wrist strap is attached using locking bolts 32. Typically, the wrist strap 92 could be attached using any bolts rigidly attached to sides of the bow or archery bow stabilizer and prop 10.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. An archery bow stabilizer and prop comprising:

a locking adapter having a first end and a second end, said first end having parallel extensions for fitting over a handle of a bow;

a transition elbow having a body and a shaft, said body attachable to said second end of said locking adapter, a longitudinal bore extends through said body for receiving a bolt, said bolt attaches and secures said archery bow stabilizer and prop to the bow, said shaft having a first threaded bore and a second threaded bore in a perpendicular relationship; and a stabilizer-prop having a first end and a second end, said first end attached to either said first or said second threaded bore on said shaft of said transition elbow, said stabilizer-prop extending outward in a horizontal position for use as a stabilizer when attached to said first threaded bore; and said stabilizer-prop extending downward in a vertical position for said stabilizer-prop to function as a bow prop when attached to said second threaded bore.

2. The archery bow stabilizer and prop as set forth in claim 1 in which said locking adapter further comprises a plurality of threaded holes within said second end, said threaded holes receiving bolts to lock said transition elbow in said locking adapter.

3. The archery bow stabilizer and prop as set forth in claim 1 further comprising a wrist strap, said wrist strap attached to said locking adapter by bolts.

4. The archery bow stabilizer and prop as set forth in claim 1 in which said body of said transition elbow further comprises a shank that fits within an opening in said second end of said locking adapter.

5. The archery bow stabilizer and prop as set forth in claim 4 in which said shank contains dimples for receipt of bolt ends from bolts extending through sides of said opening in said second end of said locking adapter for locking said transition elbow in said locking adapter and preventing said transition elbow from rotation within said locking adapter.

6. The archery bow stabilizer and prop as set forth in claim 1 in which said body of said transition elbow further comprising a slotted opening; said shaft further containing a flattened portion, said flattened portion pivotally attached within said slotted opening, said shaft pivoting about a pivot device and being lockable in a first position or a second position.

7. The archery bow stabilizer and prop as set forth in claim 1 in which said stabilizer-prop comprises an elongated staff of a predetermined length having a threaded rod extending from one end, said threaded rod fitting within said first or second threaded bore in said transition elbow.

8. The archery bow stabilizer and prop as set forth in claim 1 further comprising a receiver, said receiver having an aperture for receiving said second end of said stabilizer-prop, said receiver attached to a hunting surface, said receiver holding said stabilizer-prop in a vertical position to hold the archery bow in a ready position.

9. The archery bow stabilizer-prop as set forth in claim 1 in which said stabilizer-prop comprises a telescoping staff, said telescoping staff being lockable at any position between a low position and a high position to provide length and height adjustment of said archery bow stabilizer-prop.

10. The archery bow stabilizer and prop as set forth in claim 1 in which said second end of said stabilizer-prop contains a spike, said spike being insertable into earth or other soft hunting surfaces to hold an archery bow in a ready position.

11. The archery bow stabilizer and prop as set forth in claim 1 further comprising an extension, said extension attachable to said transition elbow to extend length of said transition elbow extending from said locking adapter.

12. The archery bow stabilizer and prop as set forth in claim 1 further comprising a centering adapter, said centering adapter being a cylindrical plug with a longitudinal off centered bore therethrough, and a threaded bore centered on a front surface thereof, a bolt inserted through said off centered bore screws into said first threaded bore on said transition elbow to secure said centering adapter on said transition elbow, said threaded bore on said face of said centering adapter functioning as said first threaded bore on said transition elbow, and functioning to center attachment of a stabilizer-prop to said transition elbow.

13. An archery bow stabilizer and prop comprising:

a locking adapter having a first end and a second end, said first end having parallel extensions for fitting over a handle of a bow, said second end having an opening defined by exterior walls of said opening, said exterior walls of said opening of said second end having a plurality of threaded holes for receiving locking bolts;

a transition elbow comprising a body and a shaft, said body containing a shank and a slotted opening on an end opposite of said shank, said shank insertable into said opening on said second end of said locking adapter, said locking bolts locking said transition elbow to said second end of said locking adapter, a longitudinal bore extends through said body for receiving a bolt, said bolt attaches and secures said archery bow stabilizer and prop to the bow, said shaft having a flattened portion, said flattened portion pivotally attached within said slotted opening, said shaft pivoting about a pivot device and being lockable in a first position or a second position, said flattened portion having a first threaded bore and a second threaded bore in a perpendicular relationship; and a stabilizer-prop having a first end and a second end, said first end attached to either said first or said second threaded bore on said shaft of said transition elbow, said stabilizer-prop extending outward in a horizontal position for use as a stabilizer when attached to said first threaded bore; and said prop extending downward in a vertical position for said stabilizer-prop to function as a bow prop when attached to said second threaded bore; and a receiver, said receiver having an aperture for receiving said second end of said stabilizer-prop, said receiver attached to a hunting surface, said receiver holding said stabilizer-prop in a vertical position to hold the archery bow in a ready position.

14. The archery bow stabilizer and prop as set forth in claim further comprising a wrist strap, said wrist strap attached to said locking adapter by said locking bolts in said threaded penetrations.

15. The archery bow stabilizer and prop as set forth in claim 13 in which said shank further comprises dimples for receipt of ends of said locking bolts extending into said opening in said second end of said locking adapter for locking said transition elbow in said locking adapter and preventing said transition elbow from rotation within said locking adapter.

16. The archery bow stabilizer and prop as set forth in claim 13 in which said stabilizer-prop comprises an elongated staff of a predetermined length having a threaded rod extending from one end, said threaded rod fitting within said first or second threaded bore in said transition elbow.

17. The archery bow stabilizer-prop as set forth in claim 13 in which said stabilizer-prop comprises a telescoping staff, said telescoping staff being lockable at any position between a low position and a high position to provide length and height adjustment of said archery bow stabilizer-prop.

18. The archery bow stabilizer and prop as set forth in claim 13 in which said second end of said stabilizer-prop contains a spike, said spike being insertable into earth, other soft hunting surfaces or into said receiver to hold an archery bow in an upright ready position.

19. An archery bow stabilizer and prop comprising:

a stabilizer-prop, said stabilizer-prop being an elongated rod having a first end and a second end, said first end having an attachment means;

a transition elbow having a main body area and an attachment area, said attachment area having a first and a second threaded bore in perpendicular relationship, said attachment means on said stabilizer-prop attachable to said first threaded bore for horizontal position of said stabilizer-prop for use as a stabilizer or in said second threaded bore for vertical position of said stabilizer-prop for use as a bow prop; and a mounting means for attaching said archery bow stabilizer and prop to an archery bow, said mounting means having bow mounting end and a transition elbow mounting end, said main body area of said transition elbow attachable to said transition elbow mounting end on said mounting means, a longitudinal bore extends from said transition elbow mounting end to said bow mounting end for receiving a mounting bolt, said mounting bolt extending through said longitudinal bore and screwed into a threaded bore on the bow to attach said mounting means to the archery bow.

20. The archery bow stabilizer and prop as set forth in claim 19 in which said stabilizer-prop comprises a telescoping staff, said telescoping staff lockable at any position between a low position and a high position to provide height adjustment for said archery bow stabilizer and prop.

21. The archery bow stabilizer and prop as set forth in claim 19 in which said stabilizer-prop comprises a single length staff of a predetermined length.

22. The archery bow stabilizer and prop as set forth in claim 19 in which said stabilizer-prop comprises a three piece extendable, collapsible telescopic staff, said staff being lockable in any position between a close in position and a far out position, said staff being used as a stabilizer in the collapsed position when screwed into said first threaded bore.

23. The archery bow stabilizer and prop as set forth in claim 19 in which said stabilizer-prop further comprises a spike at said second end of said stabilizer-prop, said spike for insertion into ground or other soft hunting surface.

24. The archer bow stabilizer and prop as set forth in claim 19 further comprising a receiver, said receiver having an opening for receiving the second end of said stabilizer-prop, said receiver being attachable to a hunting surface.

25. The archery bow stabilizer and prop as set forth in claim 24 in which said receiver further comprising a plurality of openings for receipt of multiple stabilizer-props for holding a plurality of archery bows in a row.

26. The archery bow stabilizer and prop as set forth in claim 19 in which said transition elbow mounting end of said mounting means comprising parallel arms, said main body area of said transition elbow inserted and secured between said parallel arms.

27. The archery bow stabilizer and prop as set forth in claim 26 in which said transition elbow is pivotally installed between said parallel arms, said transition elbow pivoting from a first position to a second position, said transition elbow pivoting about a pivot device and lockable in position by a lock pin.

28. The archery bow stabilizer and prop as set forth in claim 27 in which said bow mounting end of said mounting means comprising a pair of parallel extensions to fit over the handle of the bow to prevent said archery bow stabilizer and prop from rotating on said bow.

29. An archery bow stabilizer and prop comprising:

a generic mounting block, said generic mounting block having a bow face, top face, bottom face, side faces and forward face, a longitudinal bore extends through said generic mounting block from said forward face to said bow face, said longitudinal bore having two diameters to create a ledge with said bore, a bolt is inserted into and extends through said bore to attach and secure said generic mounting block to an archery bow;

a pair of anti-rotation arms, said anti-rotation arms in a parallel spaced relationship attached to said bow face on said generic mounting block, said anti-rotation arms fitting over a handle of the archey bow to prevent said generic mounting block from rotating;

a first threaded bore on said forward face on said generic mounting block;

a second threaded bore on said bottom face on said generic mounting block, said second threaded bore in a perpindicular relationship with said first threaded bore; and a stabilizer-prop being a staff having a first end and a second end, said first end attachable to said first and said second threaded bores, said stabilizer-prop being in a horizontal position when attached to said first threaded bore to function as a stabilizer, and said stabilizer-prop being in a vertical position when attached to said second threaded bore to function as a bow prop; said second end of said stabilizer-prop resting upon a hunting surface to support the archery bow at ready height.

30. The archery bow stabilizer and prop as set in claim 29 further comprising a reciever, said receiver having an opening for receiving the second end of said stabilizer-prop, said receiver being attachable to a hunting surface.

31. The archery bow stabilizer and prop as set forth in claim 29 further comprising a plurality of said generic mounting blocks, said mounting blocks being aligned forward face to said bow face of a next generic mounting block, a longer length mounting bolt being used to attach and secure said plurality of generic mounting blocks to the archery bow, said plurality of generic mounting blocks being joined to provide additional clearance between the archery bow and said stabilizer-prop when said stabilizer-prop is attached to said second threaded bore.

32. The archery bow stabilizer and prop as set forth in claim 31 further comprising alignment pins, said alignment pins inserted in opposing alignment holes in said bow face and said forward face, said alignment pins holding said generic mounting blocks in alignment and preventing said generic mounting blocks from rotation about each other.

* * * * *